United States Patent [19]

Keefer

[11] Patent Number: 4,521,929

[45] Date of Patent: Jun. 11, 1985

[54] HEATED WATERBED

[75] Inventor: Donald W. Keefer, Pasadena, Md.

[73] Assignee: Classic Corp., Jessup, Md.

[21] Appl. No.: 577,360

[22] Filed: Feb. 6, 1984

[51] Int. Cl.[3] ..... A47C 27/08

[52] U.S. Cl. ..... 5/422; 5/451; 5/455

[58] Field of Search ..... 5/422, 451, 450, 452, 5/455, 449

[56] References Cited

U.S. PATENT DOCUMENTS

| | | | |
|---|---|---|---|
| 779,576 | 1/1905 | Berryman | 5/455 |
| 2,842,651 | 7/1958 | Neely | 219/19 |
| 3,014,117 | 12/1961 | Madding | 219/46 |
| 3,085,568 | 4/1963 | Whitesell | 128/33 |
| 3,746,835 | 7/1973 | Yu et al. | 219/217 |
| 4,233,492 | 11/1980 | McMullan et al. | 219/217 |
| 4,242,766 | 1/1981 | Allegro | 5/422 |

*Primary Examiner*—Alexander Grosz

*Attorney, Agent, or Firm*—Finnegan, Henderson, Farabow, Garrett and Dunner

[57] ABSTRACT

The present invention provides a heated waterbed comprising: an outer frame and a frame base together defining a central cavity; a sunken frame positioned underneath a portion of the central cavity, the sunken frame defining a cavity well; a heating unit positioned at the bottom of the cavity well; a water-filled container overlying the heating unit in the cavity well; and a plurality of water-filled receptacles together forming a waterbed mattress positioned in the central cavity, a portion of each receptacle being in contact with the water-filled container in the cavity well.

14 Claims, 3 Drawing Figures

HEATED WATERBED

BACKGROUND OF THE PRESENT INVENTION

The present invention relates generally to flotation sleep systems and, more particularly, to a heated waterbed having a plurality of water-filled receptacles or tubes as a mattress and a heating unit to heat the mattress.

It is usually desirable to use a heating unit in a waterbed construction to provide a heated flotation sleep system upon which the individual lies or sleeps. In the absence of a heating unit, the water-filled waterbed mattress remains cold and uncomfortable to the individual, especially during the winter months.

Likewise, it is usually preferable to construct a flotation sleep system so that the waterbed mattress is composed of a plurality of individual water-filled units, as opposed to one large water-filled mattress. Such a plurality of water-filled units provides a smoother, less oscillating mattress surface than one large water-filled mattress. Moreover, the use of a number of smaller, individual water-filled units prevents excessive damage to the surrounding room from a leak and makes it easier to fill and transport the waterbed.

However, it previously has not been possible to use effectively in the same waterbed construction both a heating unit and a plurality of water-filled units, without causing numerous safety hazards. The plurality of water-filled units have a propensity to form a number of air gaps. When an air gap is contacted by the heating unit, the air within the air gap is heated to a temperature in excess of a safe maximum temperature. Such an overheating of the air in the air gap causes damage to the waterbed, as well as posing a safety and fire hazard.

The problem of air gap overheating due to contact with the heating unit has developed as a result of the nature and construction of waterbed heater pads, as presently available in the waterbed industry. Basically, all waterbed heater pads are composed of resistance electrical circuits. Such resistance circuits are generally constructed of either etched metal, wire, or a carbon particle mat. In all cases, regardless of the material used, an electric current is passed through the conductive material that creates a certain degree of resistance to the passage of the current. This resistance causes the material to generate heat.

The resistance circuit is usually encased in an insulating polymeric material, such as vinyl or rubber. The flow of the electric current to the heater pad is typically regulated by means of a controller, which turns the power on and off based upon the setting made and the water temperature, as measured by a thermostat probe. One type of controller, however, also turns the current on and off based upon a thermostatic setting that measures and responds to the ambient room temperature.

Underwriter's Laboratories (U.L.) standards require that the electrical connection to the heater pad, located in a housing on the top side of the pad, contains a fixed thermostat, which is known in the industry as a safety-override thermostat. The purpose of the safety-override thermostat is to break the flow of electric current to the heater circuit of the heater pad, if the water temperature surrounding the safety-override thermostat reaches between 135° and 145° F.

If an air gap occurs between the heater pad surface and the bottom of the waterbed mattress, an insulation effect can take place in the area around the air gap.

Since the position of this insulation effect prevents the heater pad, in contact with the air gap, to dissipate its heat, as a result the air gap builds up heat and eventually reaches a temperature that will melt or burn the polymeric insulation materials of the heater pad and any other adjacent materials.

If such an air gap occurs in the area directly around the safety-override thermostat, the safety-override thermostat alleviates the problem of heat build up by breaking the current flow to the heater pad. However, the area around the thermostat is only a few square inches and, hence, the likelihood of an air gap occurring in another area of the heater pad is significant. When the air gap forms in an area away from the thermostat, the safety-override thermostat continues to sense a water temperature below the minimum temperature needed to activate the safety cut-off, such as 135° F.

Consequently, in most cases, the safety-override thermostat provides no protection against burn-outs caused by the overheating of the air gaps. Heater pad manufacturers call attention to this danger, by warning that the area directly over the heater pad should be free of any wrinkles and air gaps when a waterbed liner and mattress are installed.

When a single heater pad is placed directly in contact with a dual waterbed mattress or a waterbed mattress composed of a plurality of water-filled containers, the air gap overheating problem, previously described, can occur with a greatly increased frequency. This is due to the fact that there is a tendency for air gaps to occur in-between the dual waterbed mattresses and water-filled containers, as they are installed in a side by side manner within the waterbed construction.

The problem of air gap overheating has previously rendered the heating of dual waterbed matresses or multiple container waterbed mattress systems very ill advised. As a result of the air gap overheating problem, multiple container waterbed mattress systems have not been able to be heated safely and, therefore, the users of the waterbed are denied one of the major benefits of a flotation sleep system, namely, heat.

SUMMARY OF THE INVENTION

It is therefore a main object of the present invention to provide a heated waterbed that overcomes the aforementioned drawbacks.

It is a more specific object of the invention to provide a heated waterbed having a plurality of heated water-filled receptacles or tubes.

It is another specific object of the invention to provide a heated waterbed having a heating unit or heater pad capable of heating a plurality of water-filled receptacles or tubes without causing overheating.

It is another object of the invention to provide a heated waterbed that is safe to use without posing a fire hazard.

It is another object of the invention to provide a heated waterbed that is efficient and economical to use.

Additional objects and advantages of the invention will be set forth in part in the description which follows, and in part will be obvious from the description, or may be learned by practice of the invention. The objects and advantages of the invention may be realized and obtained by means of instrumentalities and combinations, particularly pointed out in the appended claims.

To achieve these objects and in accordance with the purpose of the invention, the present invention provides a heated waterbed comprising an outer frame and a frame base together defining a central cavity; a sunken frame positioned underneath a portion of the central cavity, the sunken frame defining a cavity well; a heating unit positioned at the bottom of the cavity well; a water-filled container overlying the heating unit in the cavity well; and a plurality of water-filled receptacles together forming a waterbed mattress positioned in the central cavity, a portion of each water-filled receptacle being in contact with the water-filled container in the cavity well.

In another embodiment, the present invention also provides a heated waterbed comprising a four-sided outer frame and a frame base together defining a central cavity; a four-sided sunken frame positioned underneath the central cavity, the sunken frame defining a cavity well; a heater pad positioned at the bottom of the cavity well; a water-filled container overlying the heater pad in the cavity well; and a plurality of water-filled tubes together forming a waterbed mattress positioned longitudinally in the central cavity, a portion of each tube being in contact with the water-filled container in the cavity well.

The present invention obviates the problems associated with previous heated waterbeds, and achieves the objects of the invention. The present invention provides a heated waterbed that has both a plurality of water-filled receptacles or tubes and a heating unit or heater pad that heats the water-filled receptacles or tubes without causing overheating. As a result, the present invention provides a heated waterbed that is safe to use without posing a fire hazard.

Moreover, the heated waterbed of the present invention is efficient and economical to use, since it permits the usage of a standard heating unit or heater pad and temperature control unit with a waterbed mattress containing a plurality of water-filled receptacles or tubes. Consequently, the waterbed provides a consumer product that affords relatively complete safety and comfort, at a reasonable cost.

The foregoing and other objects, features, and advantages of the present invention will be made more apparent from the following description of the preferred embodiments.

BRIEF DESCRIPTION OF THE DRAWINGS

The accompanying drawings, which are incorporated in and constitute a part of the specification, illustrate various embodiments of the invention and, together with a description, serve to explain the principles of the invention.

DETAILED DESCRIPTION OF THE PREFERRED EMBODIMENT

Figure 1:
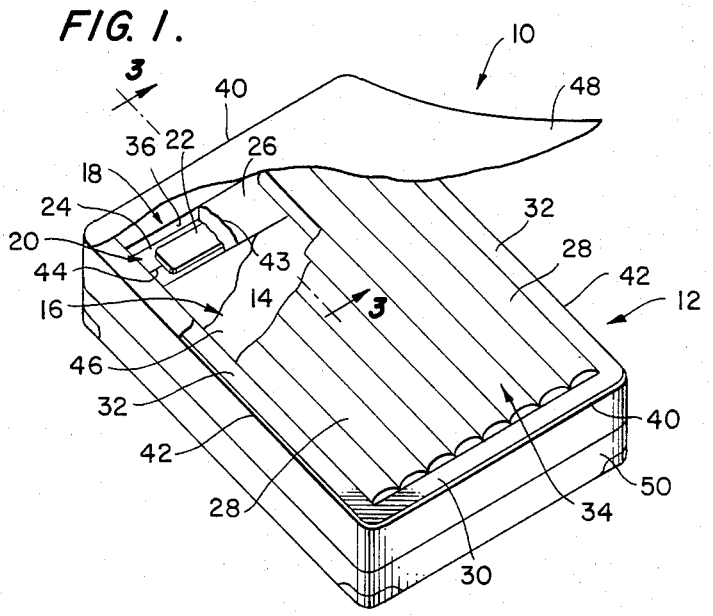
FIG. 1 is a partially cutaway perspective view, of an embodiment of the heated waterbed of the present invention.
Figure 2:
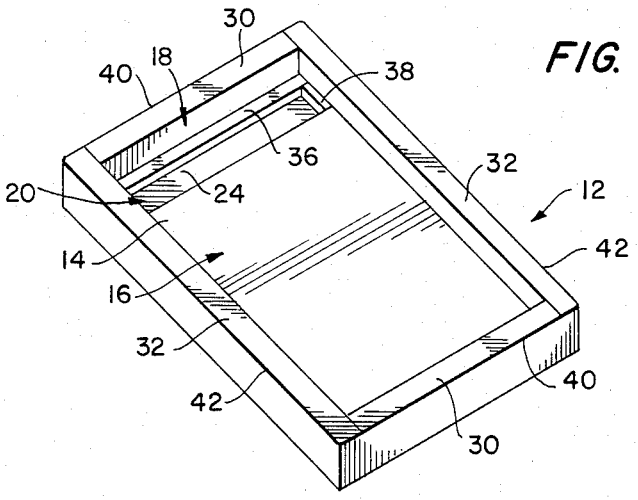
FIG. 2 is a perspective view of the outer frame and the sunken frame used in the waterbed of FIG. 1.
Figure 3:
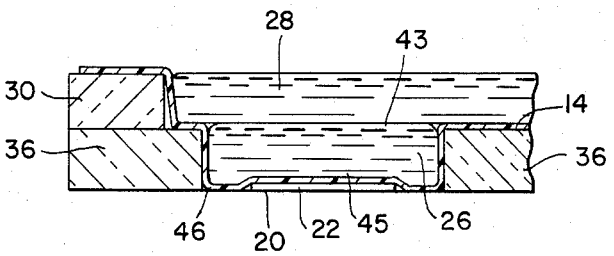
FIG. 3 is a partial cross section of the waterbed in FIG. 1 taken along line 3—3 thereof.

Reference will now be made in detail to the embodiments of the invention, which are illustrated in the accompanying drawings. As shown in FIGS. 1-3, in a preferred embodiment of the present invention, a heated waterbed 10 has an outer frame 12 and a frame base 14, which together define a central cavity 16. A sunken frame 18 is positioned underneath a portion of the central cavity 16; the sunken frame 18 defines a cavity well 20.

A heating unit 22 is positioned at the bottom of the cavity well 20. A water-filled container 26 overlies the heating unit 22 in the cavity well 20. A plurality of water-filled receptacles 28 are positioned in the central cavity 16. A portion of each water-filled receptacle 28 is in contact with the water-filled container 26 in the cavity well 20 to conduct or dissipate heat from the heating unit 22 through the water-filled container 26 to the water-filled receptacles 28. Preferably, the water-filled containers 26 and receptacles 28 are made of materials known in the art, such as plastic.

As shown in FIGS. 1 and 2, the outer frame 12 is a four sided frame construction having two parallel lateral outer frame members 30 and two parallel longitudinal outer frame members 32. Typically, the lateral outer frame members 30 and the longitudinal outer frame members 34 are assembled to form an outer frame 12 of rectangular configuration, which along with the frame base 14 defines a rectangular central cavity 16 into which the water-filled receptacles 28 can be placed to provide a waterbed mattress 34.

Likewise, the sunken frame 18 is preferably a four sided frame construction that is positioned underneath the central cavity 16. The sunken frame 18 has two parallel lateral sunken frame members 36 and two parallel longitudinal sunken frame members 38. The lateral and longitudinal sunken frame members 36 and 38 are assembled to form a rectangular sunken frame 18, which defines the cavity well 20 into which the water-filled container 26 is placed.

As shown in FIGS. 1 and 3, one of the lateral sunken frame members 36 is preferably positioned underneath one of the lateral outer frame members 30. Similarly, each longitudinal sunken frame member 38 is preferably positioned underneath one of the longitudinal outer frame members 32. The other lateral sunken frame member 36 lies beneath the frame base 14.

As a result of this positioning, the cavity well 20 is preferably positioned laterally along one of the lateral edges 40 of the heated waterbed 10. The cavity well 20 extends along the lateral edge 40 of the waterbed 10 between the two longitudinal edges 42. Consequently, the cavity well 20 is typically located along the lateral edge 40 that is either adjacent to the headboard of the bed assembly or adjacent to the base of the bed assembly. The topside 43 of the water-filled container 26 in the cavity well 20 is even with the frame base 14 of the central cavity 16 to provide one continuous smooth surface composed of the frame base 14 and the topside 43 of the water-filled container 6.

The heater unit 22 is preferably a standard heater pad that is relatively flat and composed of resistance electrical circuits. The resistance electrical circuits can be constructed of conductive material such as etched metal, wire, carbon particle mat, or other materials known in the art. The heater pad is connected by an electric chord 44 to an electric outlet. When an electric current is passed through the heater pad, the conductive material of the heater pad provides some resistance to the passage of the current. This resistance causes the conductive material within the heater pad to generate heat.

The heater pad or heating unit 22 is positioned flat along the bottom 24 of the cavity well 20. Preferably, the heater pad lies along the entire underside 45 of the water-filled container 26 in the cavity well 20 to provide an even heating of the entire water-filled container 26, without causing the formation of an air gap between the underside 45 of the water-filled container 26 and the bottom 24 of the cavity well 20.

As shown in FIG. 1, the water-filled receptacles 28 are preferably a plurality of water-filled tubes that are adjacently positioned longitudinally in the central cavity 16 to form a waterbed mattress 34. Each tube 28 lies approximately parallel to the longitudinal outer frame members 32 of the waterbed outer frame 12. The number of water-filled receptacles or tubes 28 used to form a waterbed mattress 34 can vary, but the number is generally between 2 and 12. Other configurations of the water-filled tubes 28 are also possible within the scope of the invention.

A portion of each water-filled receptacle or tube 28 is in contact with the water-filled container 26 in the cavity well 20 to establish contact between all of the receptacles or tubes 28 and the water-filled container 26.

The water-filled container 26 is usually positioned in the cavity well 20 so that a portion of each receptacle or tube 28 is in direct physical contact with the water-filled container 26. Consequently, as the heating unit or heater pad 22 heats the water in the water-filled container 26, the water in water-filled container 26 conducts the heat to the water in the portion of each water-filled receptacle or tube 28 that is in direct physical contact with the water-filled container 26. Although only a portion of each receptacle or tube 28 is in contact with the water-filled container 26, the water in each receptacle or tube 28 then conducts the heat, received from the water-filled container 26, along the entire length of the receptacle or tube 28. As a result, a heated waterbed mattress 34 is provided.

The heated waterbed 10 avoids the safety hazards associated with the localized and concentrated heating of air gaps by the heating unit 22 since, in the present invention, the heating unit 22 lies within cavity well 20 away from the air gaps caused in the central cavity 16 by the use of a plurality of water-filled receptacles or tubes 28. In the present construction, there are few air gaps, if any, within the cavity well 20 due to the snug and close overlying relationship of the water-filled container 26 and the heating unit 22 within the cavity well 20. The water-filled receptacles or tubes 28 are heated evenly by the heated water-filled container 26, without the dangers caused by the extensive concentrated heating of an isolated air gap area.

The heated waterbed 10 can also include a liner 46 placed along the frame base 14 of the central cavity 16 and the bottom 24 of the cavity well 20 to retain any liquid that may leak from the water-filled receptacles or tubes 28 or the water-filled container 26. A mattress cover or pad 48 can also be placed on top of the waterbed mattress 34. The mattress cover or pad 48 can be constructed of various materials known in the art.

The waterbed mattress 34 can be supported above the floor by a foundation 50, which can have a plurality of legs. Preferably, the various frame members 30, 32, 36, and 38 are composed of a foam material, which acts as an insulator.

It will be apparent to those skilled in the art that various other modifications and variations could be made in the present invention without parting from the scope and content of the invention.

What is claimed is:

1. A heated waterbed comprising:

(a) an outer frame and a frame base together defining a central cavity;

(b) a sunken frame positioned underneath a portion of the central cavity, the sunken frame defining a cavity well;

(c) a heating unit positioned at the bottom of the cavity well;

(d) a water-filled container overlying the heating unit in the cavity well; and (e) a plurality of water-filled receptacles together forming a waterbed mattress positioned in the central cavity, a portion of each water-filled receptacle being in contact with the water-filled container in the cavity well.

2. The heated waterbed of claim 1, wherein the outer frame has two parallel lateral outer frame members and two parallel longitudinal outer frame members.

3. The heated waterbed of claim 2, wherein the sunken frame has two parallel lateral sunken frame members and two parallel lontigudinal frame members.

4. The heated waterbed of claim 2, wherein one of the lateral sunken frame members is positioned underneath one of the lateral outer frame members and each of the longitudinal sunken frame members is positioned underneath different longitudinal outer frame members.

5. The heated waterbed of claim 1, wherein the heating unit is a heater pad.

6. The heated waterbed of claim 1, wherein the heating unit lies along the bottom of the cavity well.

7. The heated waterbed of claim 1, wherein the topside of the water-filled container is even with the frame base of the central cavity to provide one continuous smooth surface.

8. The heated waterbed of claim 1, wherein the water-filled container is made of a plastic material.

9. The heated waterbed of claim 1, wherein the water-filled receptacles are water-filled tubes.

10. The heated waterbed of claim 9, wherein the water-filled tubes are made of a plastic material.

11. The heated waterbed of claim 9, wherein the water-filled tubes are longitudinally positioned in the central cavity.

12. The heated waterbed of claim 1, further comprising a liner along the frame base of the central cavity and the bottom of the cavity well to retain any leaking water.

13. The heated waterbed of claim 1, further comprising a mattress cover overlying the waterbed mattress.

14. A heated waterbed comprising:

(a) a four sided outer frame and a frame base together defining a central cavity;

(b) a four sided sunken frame positioned underneath the central cavity, the sunken frame defining a cavity well;

(c) a heater pad positioned at the bottom of the cavity well;

(d) a water-filled container overlying the heater pad in the cavity well; and (e) a plurality of water-filled tubes together forming a waterbed mattress positioned longitudinally in the central cavity, a portion of each tube being in contact with the water-filled container in the cavity well.

* * * * *